US009976310B1

(12) United States Patent
Kenny

(10) Patent No.: US 9,976,310 B1
(45) Date of Patent: May 22, 2018

(54) EXTRUDED ALUMINUM CANOPY WITH HIDDEN FASTENERS

(71) Applicant: Jeffrey S. Kenny, Fort Worth, TX (US)

(72) Inventor: Jeffrey S. Kenny, Fort Worth, TX (US)

( * ) Notice: Subject to any disclaimer, the term of this patent is extended or adjusted under 35 U.S.C. 154(b) by 0 days. days.

(21) Appl. No.: 14/975,014

(22) Filed: Dec. 18, 2015

(51) Int. Cl.
*E04F 10/00* (2006.01)

(52) U.S. Cl.
CPC ..... *E04F 10/005* (2013.01)

(58) Field of Classification Search
CPC ..... E04F 10/005; E04F 10/00; E04F 10/08; E04B 1/003; E04B 1/0038; E04B 1/3416; E04B 1/34; E04H 6/025
See application file for complete search history.

(56) References Cited

U.S. PATENT DOCUMENTS 2,701,397 A * 2/1955 Taylor ..... E04F 10/08 52/4
3,113,434 A * 12/1963 Phillips ..... E04B 7/20 52/11
3,375,029 A 3/1968 Frye
3,388,510 A * 6/1968 Smith ..... E04F 10/08 52/15
3,524,289 A * 8/1970 Yazejian ..... E04F 10/08 52/522
3,533,587 A * 10/1970 Smith ..... E04F 10/08 248/228.5
4,100,703 A 7/1978 Sickler
5,483,773 A 1/1996 Parisien
5,564,579 A 10/1996 Pynenburg et al.
8,104,527 B1 1/2012 Konda et al.
8,683,752 B1 4/2014 Gonzalez
8,739,473 B2 6/2014 Michel et al.
9,328,516 B2 * 5/2016 Albert ..... E04F 10/005
2004/0049993 A1 3/2004 Saldana
2015/0101260 A1 * 4/2015 Albert ..... E04F 10/005 52/15

* cited by examiner

*Primary Examiner* — Jessica L Laux
(74) *Attorney, Agent, or Firm* — James E. Walton

(57) ABSTRACT

A system and method for fabricating canopies featuring extruded members coupled together with fasteners that are hidden and are retained by multiple tracks located in the extruded members. Prefabricated corners of extruded members allow fabricators to build the canopy on site by attaching straight members to form a canopy from the four prefabricated corners.

9 Claims, 7 Drawing Sheets

EXTRUDED ALUMINUM CANOPY WITH HIDDEN FASTENERS

BACKGROUND

1. Field of the Invention

The present invention relates generally to canopies, and more specifically to a system and method for canopies that feature hidden fasteners.

2. Description of Related Art

Canopies are structures that provide shade and protection from rain. Canopies are typically affixed to the sides of buildings near doors for shelter. Canopies are also used for aesthetic purposes to decorate buildings. Conventional canopies are assembled and welded together at the shop. After welding, the canopy is sanded and then painted or finished. The canopy is then shipped to the building and hoisted up to be secured to the building. Thus conventional canopies are size limited by the ability to fabricate them and move them in one-piece to the jobsite. Additionally a large canopy is difficult to hoist due to the weight and size. Furthermore, the one piece canopy cannot be resized at the jobsite as the assembly is welded together preventing on site job adjustment. Thus, there exists significant room for improvement in the art for overcoming these and other shortcomings of conventional systems and methods for canopies attached to the side of buildings.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
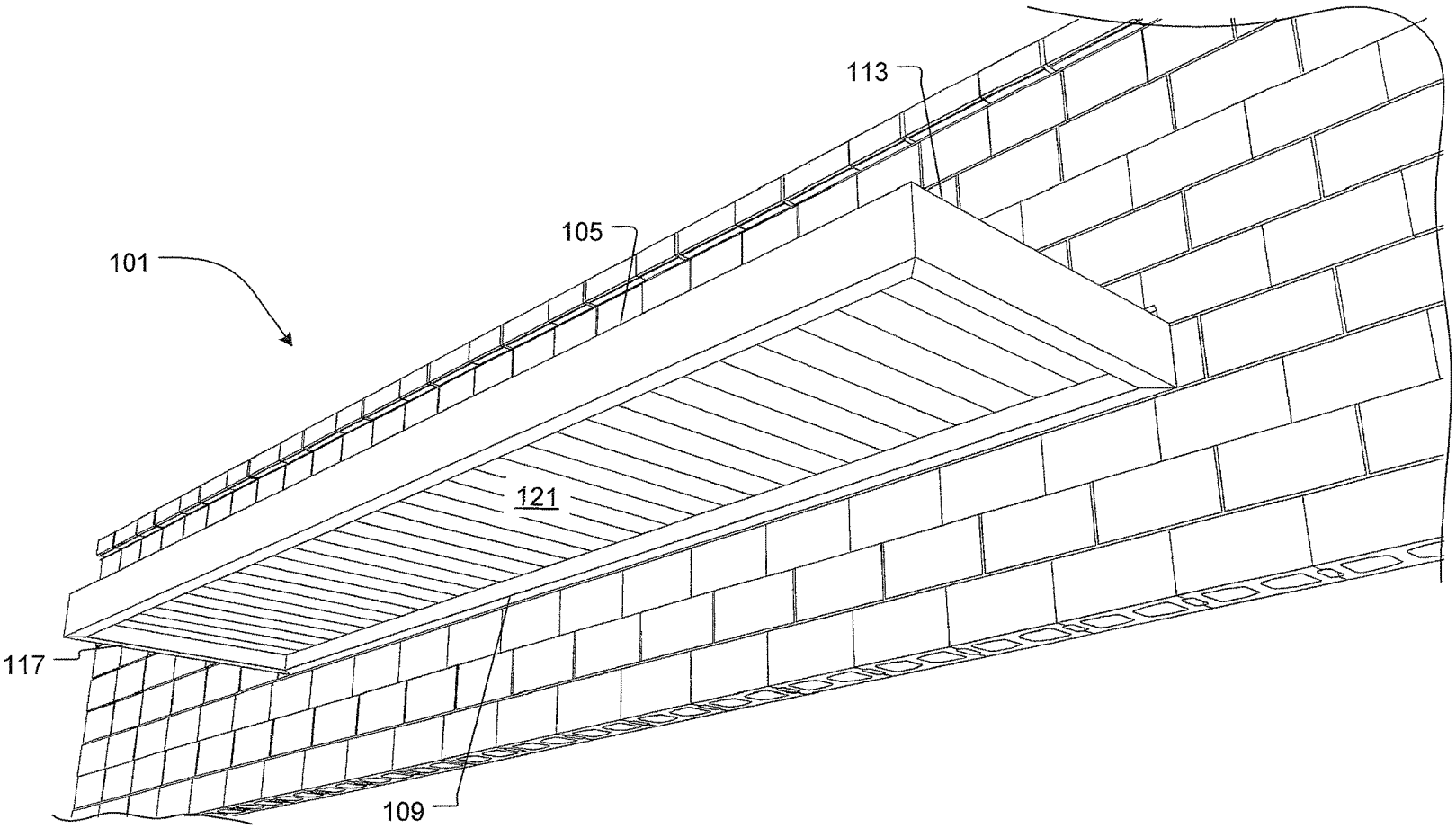
FIG. 1 is a generally downward perspective view of a canopy according to the present application.
Figure 2:
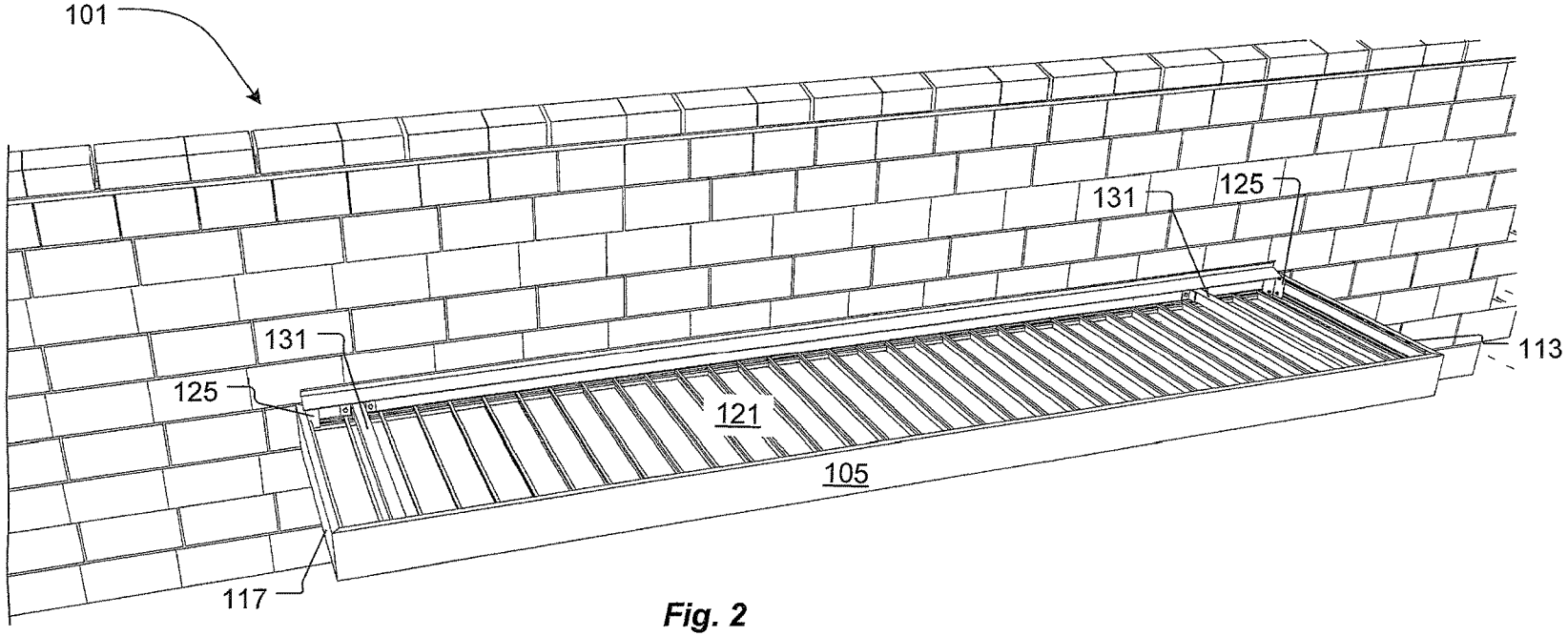
FIG. 2 is a generally upward perspective view of a canopy according to the present application.
Figure 4:
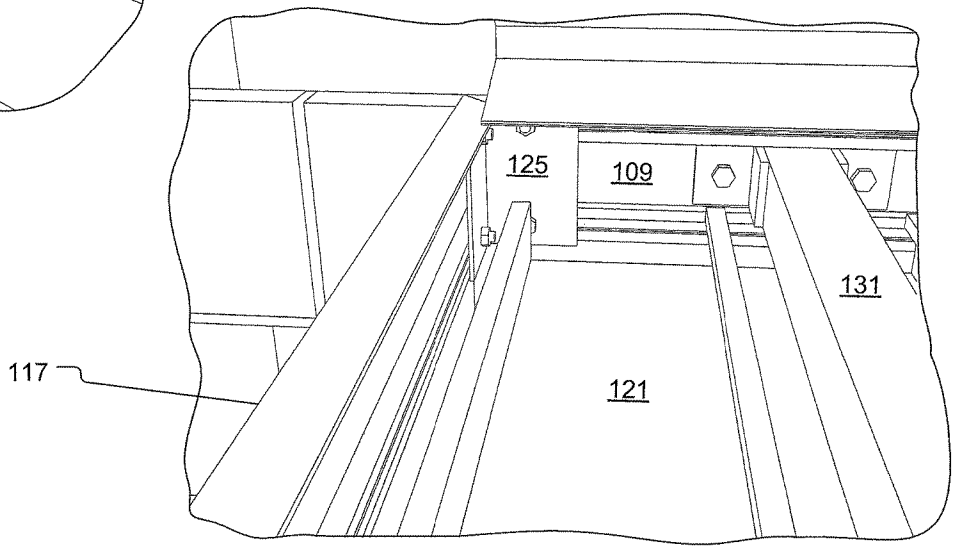
FIG. 4 is a magnified perspective view of the canopy in FIG. 2 according to the present application.
Figure 3:
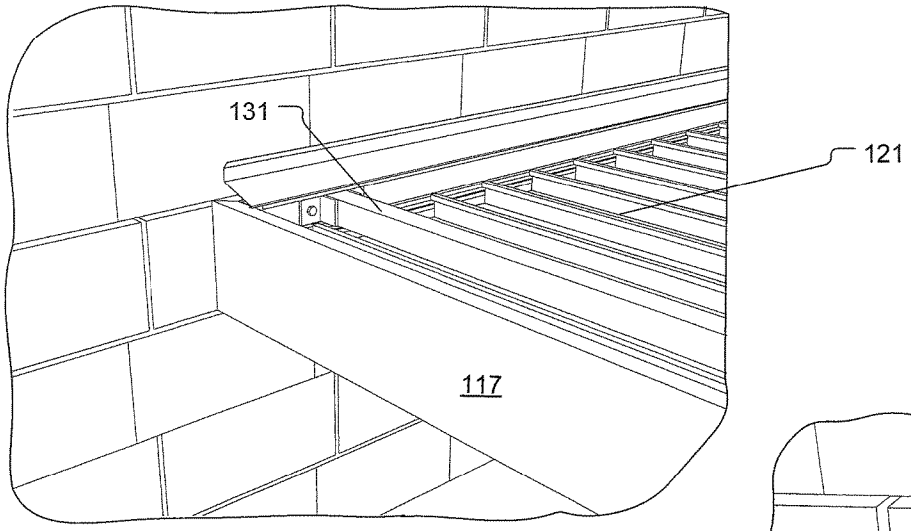
FIG. 3 is a magnified perspective view of the canopy in FIG. 2 according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the extruded aluminum canopy with hidden fasteners system and method are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1-4 in the drawings, a preferred embodiment of a canopy with hidden fasteners according to the present application is illustrated. Canopy 101 is comprised of a front member 105, a back member 109, a first end member 113, a second end member 117, and a deck panel 121. Canopy 101 is installed on the sides of buildings. First the back member 109 is fastened to the surface of the building. First end member 113 and second end member 117 are coupled to the back member by way of brackets 125. Front member 105 is coupled to the first end member 113 and second end member 117 by way of brackets 125 thereby forming a rectangular frame. Deck panel is then sized to fit the canopy, cut to length and width and then coupled to the rectangular frame. Deck panel 121 is typically sized to leave a substantial opening over the gutter portion of the extruded member. Alternatively the deck panel is sized to only leave a small gap above the gutter portion of the extruded member to act as a leaf guard. Deck panel is comprised of interlocked panels and is watertight so that rain falling on the canopy is directed to the extruded members and drained away. Furthermore, braces 131 are installed above the deck. Turnbuckles can be attached from the surface of the building to the braces 131 to further support canopy 101.

Canopy 101 can be cut to length in a shop or in at the installation site because the extruded members are shipped unassembled from the shop to the installation site. Furthermore, because the extruded members can be cut at the site before assembly the parts for the canopy can be adjusted at the site. For example, if the measured length of the canopy needed to be reduced, the back and front extruded members can be precisely cut to reduce the length of the canopy. Conventional welded canopies require a large amount of work to adjust the dimensions of the canopy. Since the canopy is assembled at the installation site, the amount of equipment to hoist the canopy up bit by bit is less than the amount of hoisting equipment needed for conventional welded canopies.

It should be apparent that the canopy 101 does not have fasteners viewable from underneath the canopy. The hidden fasteners of canopy 101 increase the aesthetic appeal of the canopy. Furthermore, the hidden fasteners require less finishing work and over time any corrosion due to a reaction between the fasteners and the extruded members is hidden from view.

Figure 5A:
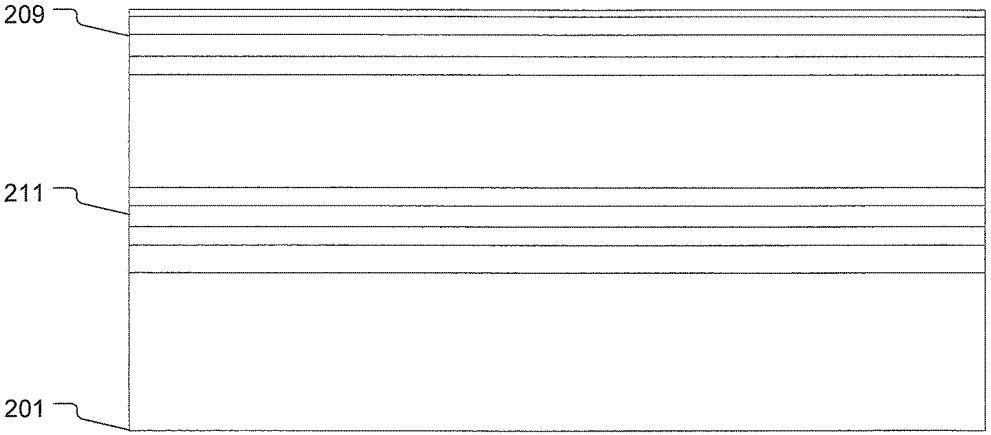
FIG. 5A is a back view of an extruded member according to the present application.
Figure 5C:
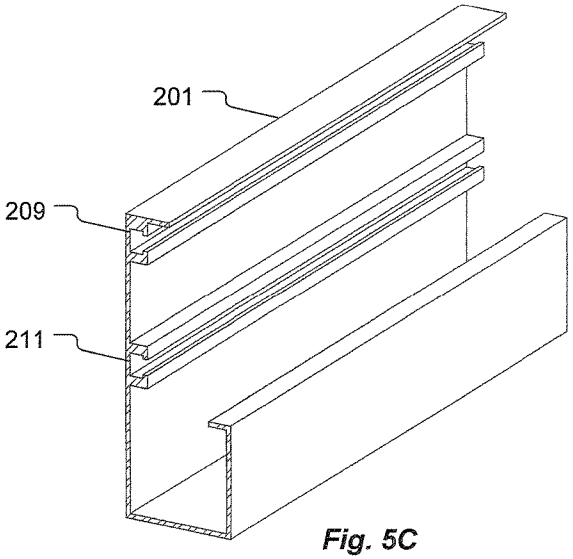
FIG. 5C is a perspective view of an extruded member according to the present application.
Figure 5B:
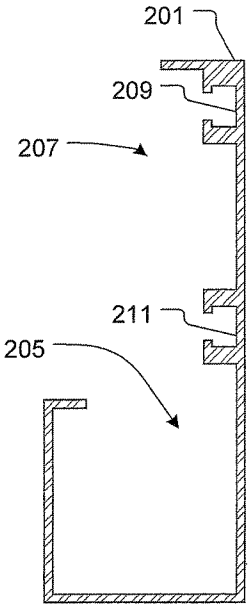
FIG. 5B is an end view of an extruded member according to the present application.

Referring now also to FIG. 5A-5B in the drawings, a preferred embodiment of an extruded member according to the present application is illustrated. Extruded member 201 is comprised of aluminum and extruded into a shape configured for use with hidden fasteners. Extruded member 201 has a gutter portion 205, a tracked portion 207, and a member length. Tracked portion 207 is comprised of at least one track 209 sized to retain a head of a bolt and prevent the bolt from twisting. The head of the bolt can be slid up and down the track however a width of the track is slightly larger than the width of the head of the bolt to prevent the bolt from rotating relative to the track. As illustrated the tracked portion further comprises of a second track 211 sized to retain a head of a bolt and prevent the bolt from twisting. It should be apparent that more tracks are contemplated by this application. Furthermore, while both tracks are illustrated outside the gutter portion 205, it should also be apparent that tracks inside the gutter portion are contemplated by this application. A benefit of locating the tracks in the tracked portion 207 is access to the tracks once the deck panel is attached. Both the first track 209 and the second track 211 run the entire length of the extruded member 201. It should be apparent that escape slots may be located in the tracks to facilitate removal and insertion of fasteners from the extruded member without being at the end of the extruded member. Escape slots are sized that the head of the fastener can be inserted or removed from the middle of the extruded member. Furthermore, there can be a plurality of offset escape slots located a set distance apart, for example every 5 foot. Offset escape slots to avoid a stress inducing line across the extrusion.

Referring now also to FIG. 6A-6D in the drawings, a preferred embodiment of an extruded member corner assembly according to the present application is illustrated. Assembly 301 is comprised of a first extruded member 305, a second extruded member 307, a bracket 311, and a plurality of fasteners 313. The plurality of fasteners is preferably comprised of bolts and nuts. First extruded member 305 is trimmed at a forty-five degree angle at the assembled end. Second extruded member 307 is trimmed at a forty-five degree angle at the assembled end.

Figure 6B:
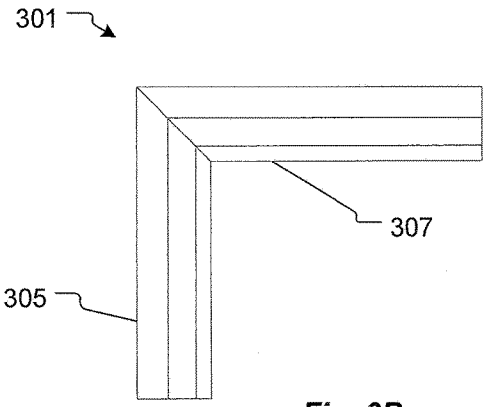
FIG. 6B is a top view of an extruded member assembly according to the present application.
Figure 6D:
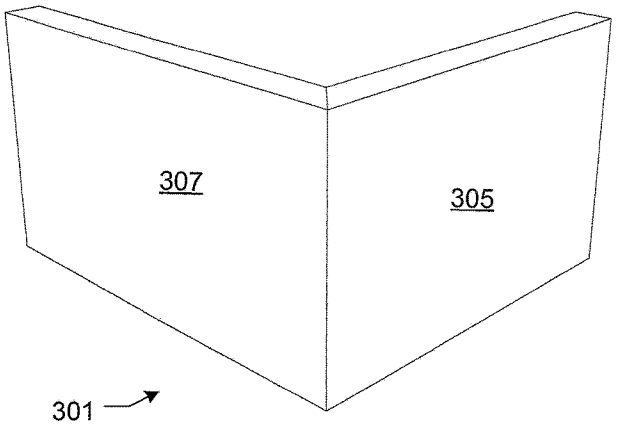
FIG. 6D is a perspective view of the front of an extruded member assembly according to the present application.
Figure 6A:
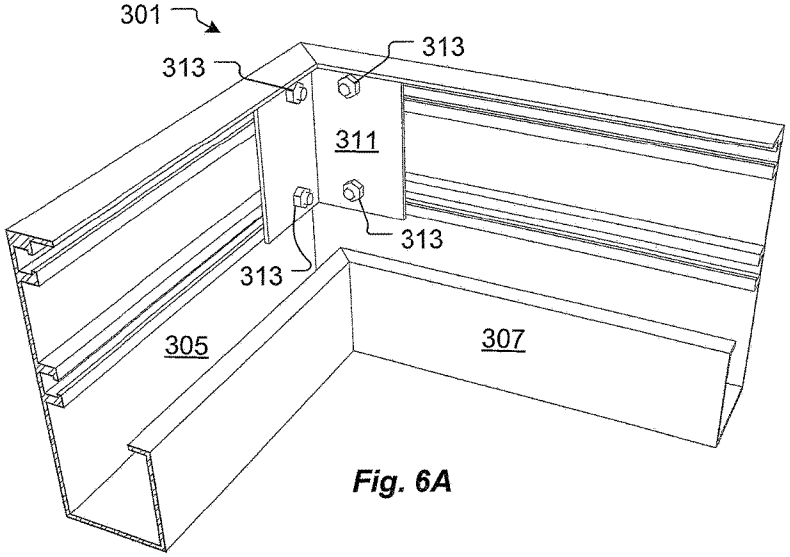
FIG. 6A is a perspective view of the back of an extruded member assembly according to the present application.
Figure 6C:
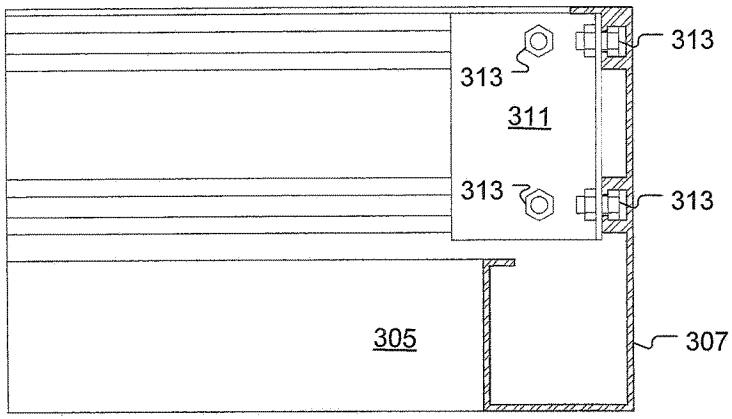
FIG. 6C is an end view of an extruded member assembly according to the present application.

To assemble the right angle assembly 301, the head of the bolts are slid into each track of the extruded members. The bracket 311 is then coupled to the bolts and secured by nuts. A colored matched filler, such as epoxy or silicone, is applied between the extruded members to fill any small gaps. Bracket 311 as illustrated is a right angle bracket and thereby forms a right angle assembly. Other shapes and angles are possible based upon the shape of the bracket. The finished corner as shown in FIG. 6D results in a canopy without exposed fasteners viewable from underneath the assembled canopy.

Figure 7B:
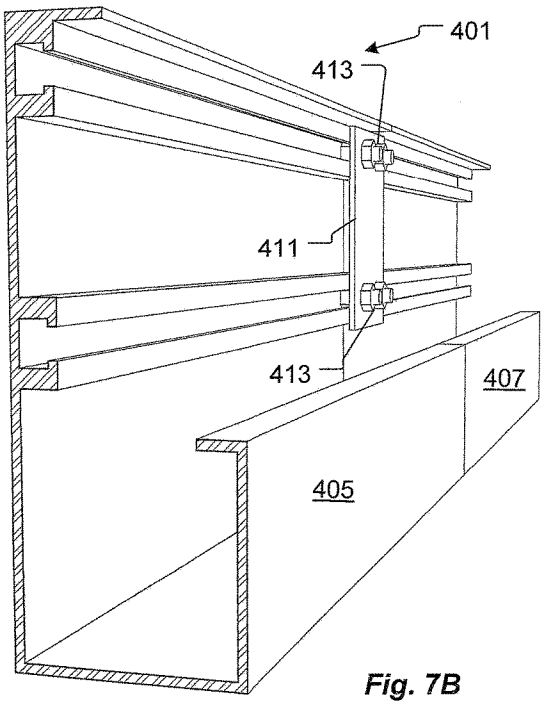
FIGS. 7A and 7B are perspective views of the back of an extruded member assembly according to the present application.
Figure 7A:
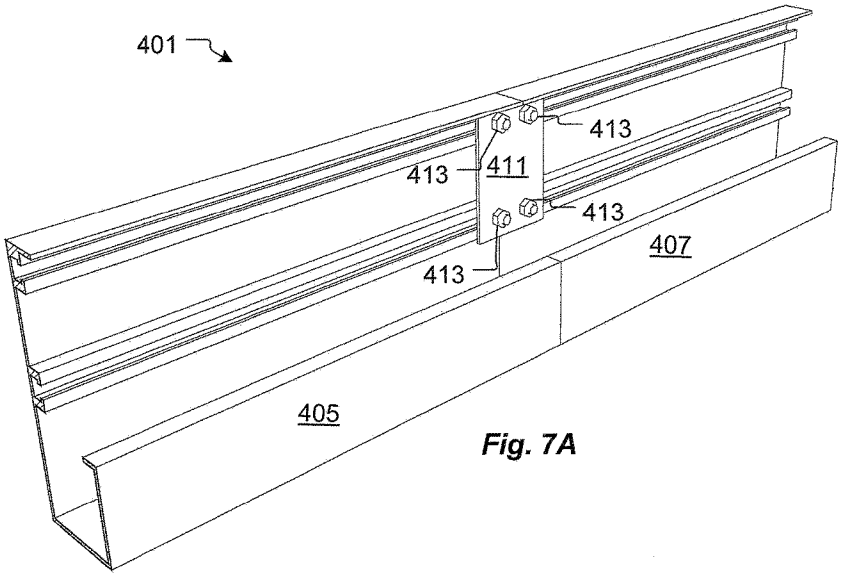

Referring now also to FIG. 7A-7B in the drawings, a preferred embodiment of an extruded member straight assembly according to the present application is illustrated. Straight assembly 401 is comprised of a first extruded member 405, a second extruded member 407, a bracket 411, and a plurality of fasteners 413. The plurality of fasteners is preferably comprised of bolts and nuts. First extruded member 405 is trimmed at a ninety degree angle at the assembled end. Second extruded member 407 is trimmed at a ninety degree angle at the assembled end.

To assemble the assembly 401, the head of the bolts are slid into each track of the extruded members. The bracket 411 is then coupled to the bolts and secured by nuts. A colored matched filler, such as epoxy or silicone, is applied between the extruded members to fill any small gaps. Bracket 411 as illustrated is a straight bracket and thereby forms a straight assembly. Other shapes and angles are possible based upon the shape of the bracket and an angle between the ends of the bracket. Assembly 401 allows users to create canopies of various lengths without limitations based upon the length of the extruded members. It should be apparent that many other shapes of canopies are contemplated by this application such as hexagons, octagons, triangles, pentagons, and trapezoids. For example a canopy having a trapezoid shape is made with brackets for example at 135 degrees and 45 degrees.

Conventionally fabricating and installing an extremely long canopy requires multiple canopies installed adjacently. The conventional system and method of installing multiple canopies adjacently produces unwanted gaps in the canopy and excess end caps between adjacent canopies. Using straight brackets, such as bracket 411, allows canopies of several hundred feet to be fabricated and installed without gaps and without unnecessary end members or end caps. It should be apparent that straight brackets can eliminate the need for end members between adjacent canopies because the new canopy is comprised of one pair of end members interconnected by as many straight members as are required to make the needed length. For example, a 100 foot long continuous canopy is comprised of a first end cap, a second end cap, a deck panel, ten front members having a 10 foot length, ten back members having a 10 foot length, four right angle brackets, eighteen straight brackets, and a plurality of fasteners.

It should be apparent that a canopy can comprised of multiple right angle assemblies 301. Furthermore, it should be apparent that multiple right angle assemblies 301 can be joined together by straight assemblies 401 to form a canopy. Additionally, the parts of the canopy can be preassembled at a shop and shipped to the installation site. For example, two right angle assemblies 301 can be formed at a shop, shipped to the installation site, and then combined to form a canopy. Alternatively, four right angle assemblies 401 can be preassembled at the shop, shipped to the installation site, and then combined by assemblies 401 to form a canopy.

The system and method described above solves problems inherent in conventional canopies. First, conventional canopies are welded together and therefore require cutting, welding, sanding, and finishing to repair a damaged canopy. The improved system comprised of extruded members can be disassembled, damaged part replaced, and reassembled without the need to weld, sand, or refinish the canopy. Second, conventional canopies have exposed fasteners viewable from the front fascia and underside of the canopy. The improved system hides the fasteners inside the canopy where they are less visible. Third, conventional systems are assembled and assembled at a shop and then trucked to the installation site, thereby limiting the size of canopy based at least upon the ability to move the conventional welded canopy. The improved system allows a canopy to be shipped unassembled and then assembled at the installation site. Furthermore, it is safer to hoist the canopy a piece at a time instead of a heavier completely assembled canopy.

A method for assembling a canopy having hidden fasteners; providing a first member having at least two tracks; providing a second member having at least two tracks; providing a bracket; providing a first set of fasteners; providing a second set of fasteners; sliding the first set of fasteners into the at least two tracks of the first member;

sliding the second set of fasteners into the at least two tracks of the second member; and coupling the first member to the second member with the bracket and both the first set of fasteners and the second set of fasteners. Furthermore, by sizing the at least two tracks of the first member to prevent the first set of fasteners rotating relative to the first member; and by sizing the at least two tracks of the second member to prevent the second set of fasteners rotating relative to the first member the sets of fasteners can be retained by the tracks without the using shims or additional members inside the tracks other than the bolt or fastener. Because the members are not welded together they can be dissembled and reassembled to replace defective members by providing a third member having at least two tracks; uncoupling the first member to the second member with the bracket and both the first set of fasteners and the second set of fasteners; sliding the first set of fasteners out of the at least two tracks of the first member; sliding the first set of fasteners into the at least two tracks of the third member; and coupling the third member to the second member with the bracket and both the first set of fasteners and the second set of fasteners.

Figure 8:
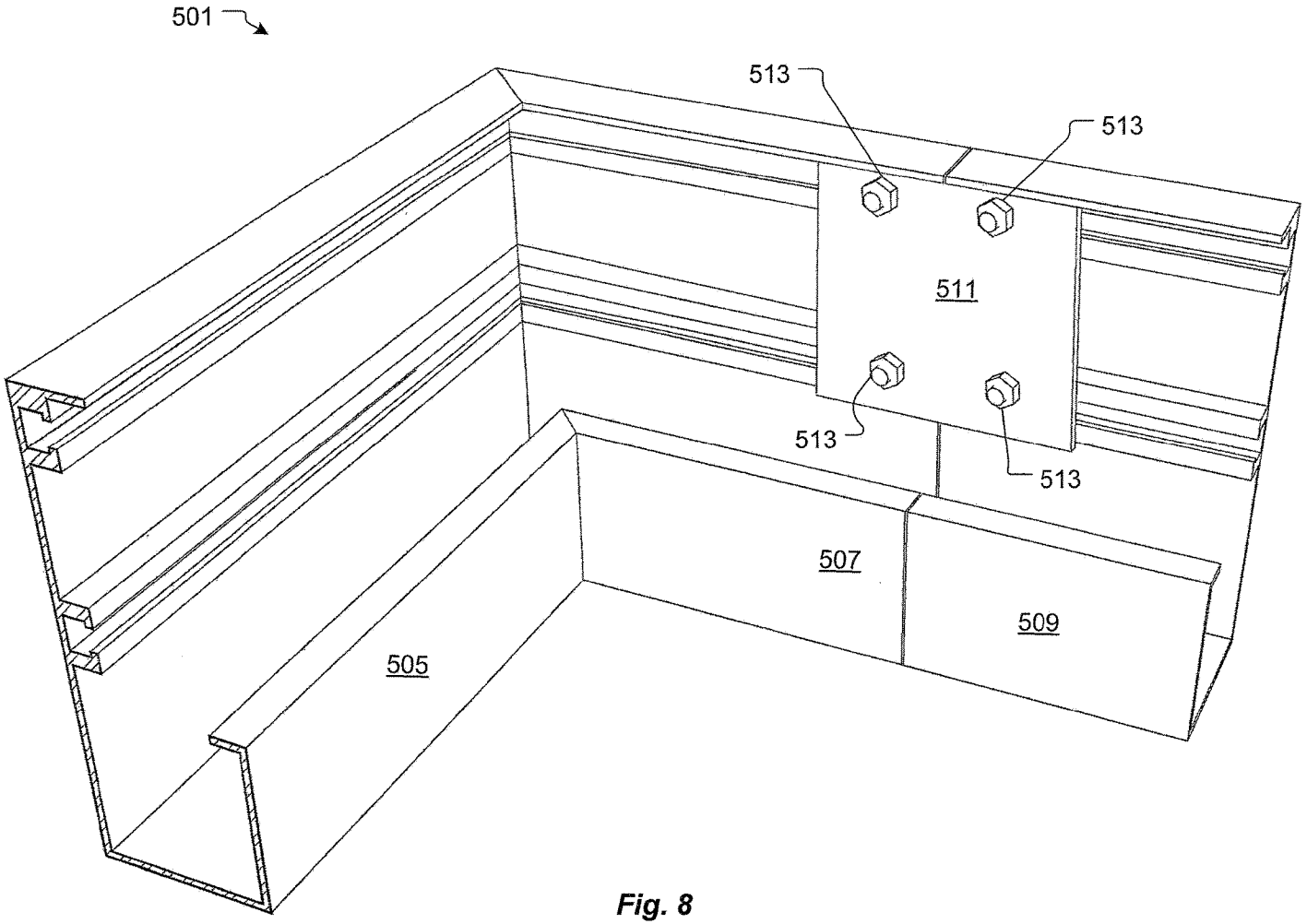
FIG. 8 is a perspective view of the back of an extruded member assembly according to the present application.

Referring now also to FIG. 8 in the drawings, an alternative embodiment of an extruded member corner assembly according to the present application is illustrated. Assembly 501 is comprised of a first extruded member 505, a second extruded member 507, a third extruded member 509, a bracket 511, and a plurality of fasteners 513. The plurality of fasteners is preferably comprised of bolts and nuts. First extruded member 505 is trimmed at a forty-five degree angle at a welded end. Second extruded member 507 is trimmed at a forty-five degree angle at a welded end. First extruded member 505 is welded to second extruded member 507 to form a 90 degree angled corner. Third extruded member 509 is coupled to the welded corner by bracket 511. This embodiment allows a user to fabricate four corners in the shop and take them out to the job site. Once there the straight extruded members can be attached with the hidden fasteners to form a canopy.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A canopy, comprising:

a first end member, having:

at least one track, having;

a first member; and a second member;

a gutter portion;

a second end member, having:

a gutter portion;

a front member, having at least one track and a gutter portion, the front member coupled to the first end member and the second end member;

a back member, having a gutter portion, the back member coupled to the first end member and the second end member;

a deck panel;

a first bolt;

a second bolt; and a bracket;

wherein the first member of the at least one track and the second member of the at least one track are spaced apart to preclude the first bolt from rotating;

wherein the first bolt and the second bolt are located above the deck panel;

wherein the first bolt and the second bolt are only visible from above the deck panel;

wherein the front member is coupled to the first end member by the bracket;

wherein a head of the first bolt is retained by the at least one track of the front member; and wherein a head of the second bolt is retained by the at least one track of the first end member.

2. The canopy according to claim 1, wherein the bracket is right angled.

3. The canopy according to claim 1, further comprising:

a brace located above the deck panel;

wherein the brace is connected between the front member and the back member.

4. The canopy according to claim 3, further comprising:

a turnbuckle.

5. The canopy according to claim 1, wherein the deck panel is configured to act as a leaf guard for the gutter portion.

6. The canopy according to claim 1, wherein the deck panel is comprised of:

a plurality of interlocked panels.

7. The canopy according to claim 1, wherein the first end member further comprises:

at least a second track;

wherein the at least first track and the at least second track are located above the gutter portion.

8. The canopy according to claim 7, further comprising:

a third bolt;

wherein a head of the third bolt is retained by the at least second track of the first end member.

9. The canopy according to claim 8, wherein the bracket spans between the first bolt, the second bolt, and the third bolt.

* * * * *